United States Patent [19]

Squires

[11] Patent Number: 4,646,439

[45] Date of Patent: Mar. 3, 1987

[54] CUTTER FOR CARPET TILES

[76] Inventor: Daniel R. Squires, 2322 S. Cedar, Independence, Mo. 64052

[21] Appl. No.: 825,567

[22] Filed: Feb. 3, 1986

[51] Int. Cl.[4] ..... B26D 7/01

[52] U.S. Cl. ..... 30/289; 30/293; 83/614; 83/743

[58] Field of Search ..... 83/614, 743, 745; 30/289, 290, 292, 293, 294

[56] References Cited

U.S. PATENT DOCUMENTS

| | | | |
|---|---|---|---|
| 3,514,855 | 6/1970 | Klekamp | 30/293 |
| 3,527,131 | 9/1970 | Ellerin | 83/614 X |
| 4,505,039 | 3/1985 | Donovan | 30/289 |

*Primary Examiner*—Donald R. Schran

*Attorney, Agent, or Firm*—Schmidt, Johnson, Hovey & Williams

[57] ABSTRACT

An improved cutter for carpet tiles is provided which can be used to quickly and accurately cut individual tile sections for completing a carpet installation between previously laid field tile and adjacent baseboards or walls. The preferred cutter includes a base plate together with a depending stop designed to engage the exposed edge of a field tile; a horizontally reciprocal, carriage-supported knife blade is mounted adjacent and above the upper surface of the plate in alignment with the stop. In practice a tile to be cut is slid under the knife until it engages the adjacent wall, whereupon the knife is moved horizontally to cleanly cut a tile section for insertion in the space therebelow. Use of a cutter in accordance with the invention can double or even triple the work output of an installer, as compared with conventional trimming practices.

7 Claims, 7 Drawing Figures

Fig.1.
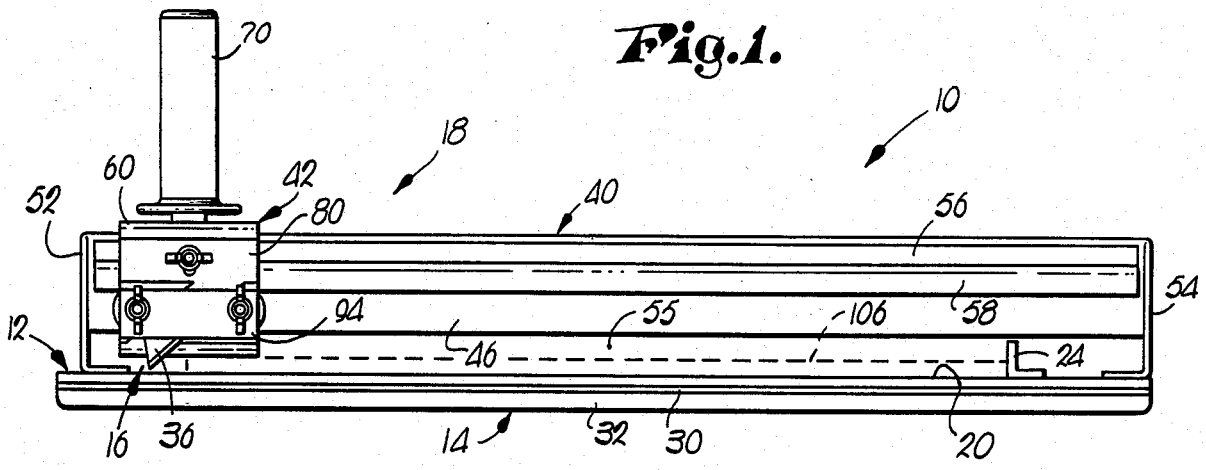
Fig.2.
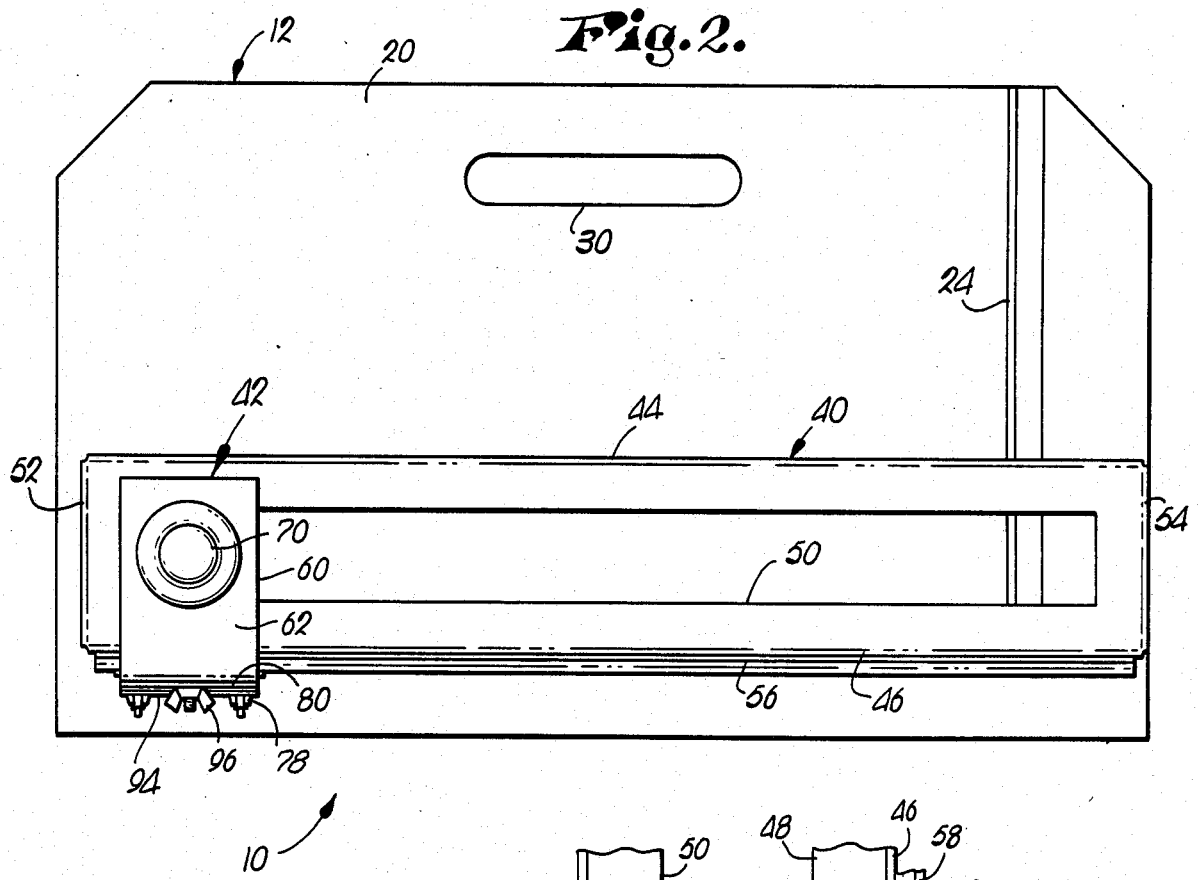
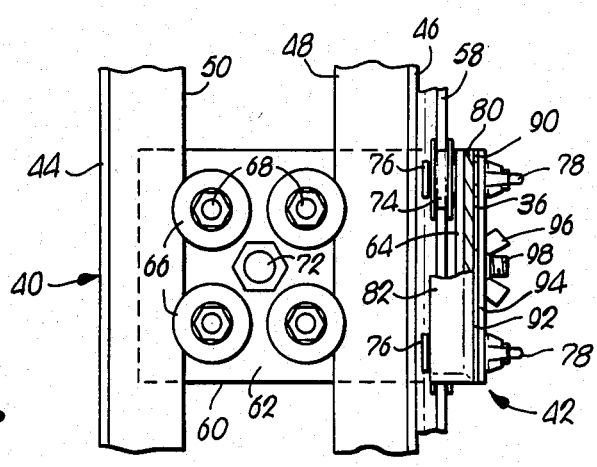
Fig.6.

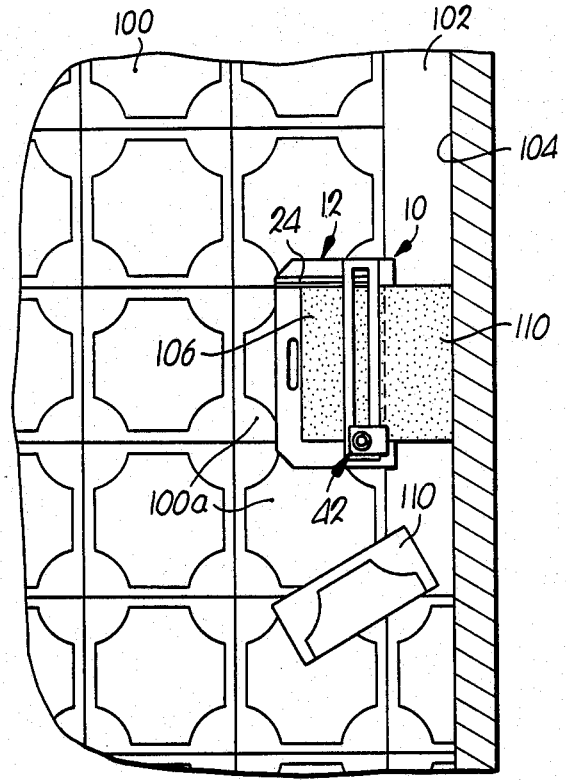
Fig.7.
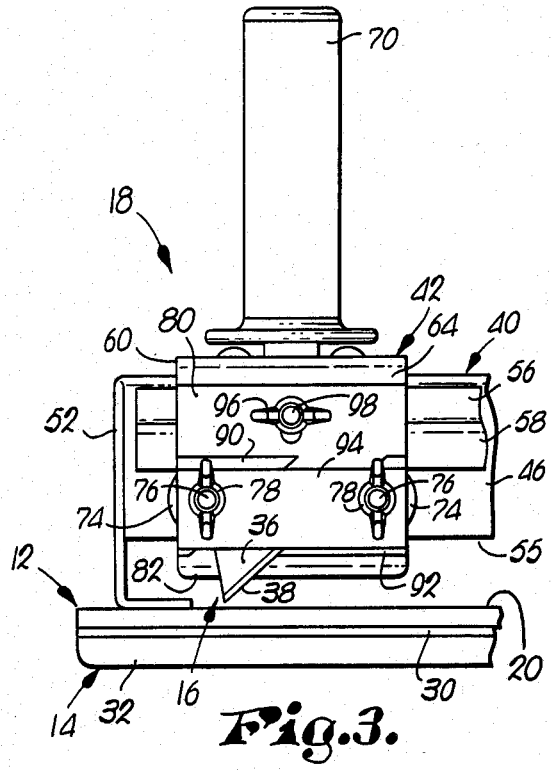
Fig.3.
Fig.5.
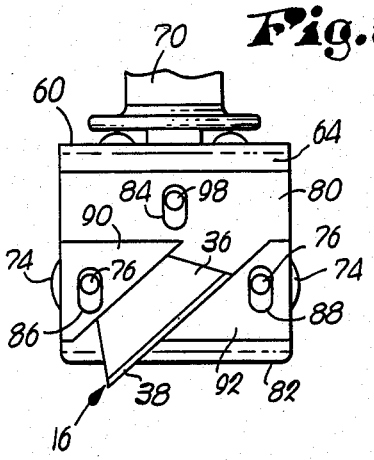
Fig.4.
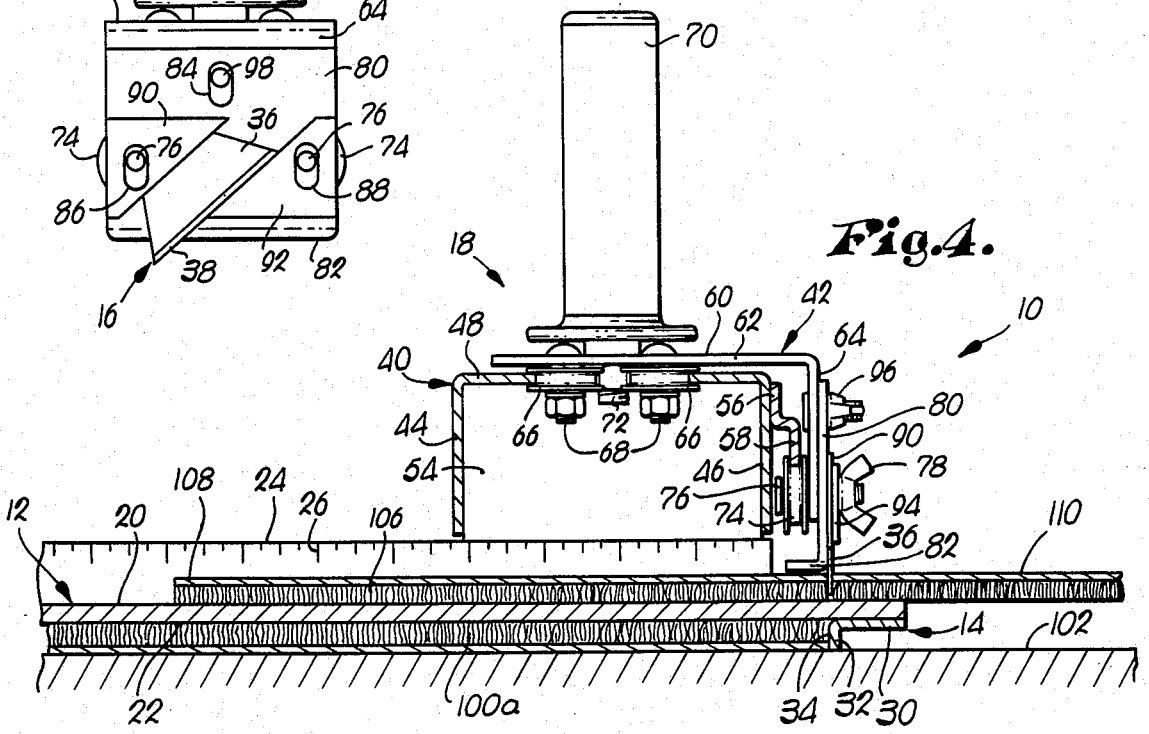

CUTTER FOR CARPET TILES

BACKGROUND OF THE INVENTION

1. Field of the Invention

The present invention relates to a cutter especially adapted for cutting carpet tiles in a quick and accurate fashion. More particularly, it is concerned with such a carpet tile cutter which is particularly designed for rapidly cutting terminal pieces of carpet to be inserted between field carpet tile and an adjacent baseboard.

2. Description of the Prior Art

The use of carpet tiles as opposed to conventional roll carpeting has significantly increased in recent years. Such carpet tiles are generally square segments of carpeting having a rubberized backing. Installation of these carpet tiles is generally very quick and rapid, owing to their ability to simply be placed on a floor with only certain of the tiles being actually adhesively secured to the floor surface. From the user's standpoint, carpet tiles of this type are particularly advantageous, inasmuch as individual tiles can be readily replaced if they become soiled or damaged.

However, the installation of carpet tiles in and around baseboards or upright wall surfaces does present a significant problem. That is to say, while the field of tiles can be laid in a very quick and rapid fashion up to a point adjacent a baseboard or the like, normally it is necessary to cut an individual tile to a specific dimension required to fill the space between the exposed edge of the adjacent field tile, and the baseboard. The typical approach used by installers in the past has been to measure the exposed floor surface and, using a straight edge or carpenter's square and a utility knife, simply cut a tile to provide the desired insert.

This technique of time cutting is of course very labor intensive and slow. The magnitude of this problem can be ascertained when it is realized that carpet tiles of the type under discussion may commonly be laid in large commercial installations, and as a consequence the time and labor involved in trimming the edge tiles represents a significant portion of the overall installation cost.

Accordingly, there is a real and unsatisfied need in the art for an efficient apparatus for the cutting of carpet tiles, particularly in instances where terminal tile sections are needed between field tiles and a baseboard or wall.

SUMMARY OF THE INVENTION

The problems outlined above are solved by the present invention which provides a simplified yet highly efficient cutter for carpet tiles. Indeed, actual use of a cutter in accordance with the invention has demonstrated that a single installer using the device can cut as many tiles as two or three workmen using conventional techniques and equipment.

Broadly speaking, the cutter of the present invention includes a base plate presenting a planar underside adapted to rest upon carpet tile, with an elongated stop depending from the base plate underside and having an elongated, upright stop surface for abutting the opposed edge of carpet tile resting upon a floor surface. The overall apparatus further includes a knife blade for cutting the carpet tile, along with means mounting the blade for horizontal, reciprocal cutting movement thereof in an elevated position above the baseplate and in cutting disposition substantially aligned with the depending stop surface. A space is provided between the upper surface of the base plate and the knife mounting means for receipt of a carpet tile to be cut.

Advantageously, the base plate includes an elongated, tile-engaging guide affixed to the upper surface of the base plate in perpendicular relationship to the depending stop; a scale may be provided on the guide for measurement purposes if desired. The knife mounting assembly preferably includes an elongated, slotted channel member secured to the upper surface of the base plate with at least a portion of the channel member spaced above the upper surface to define the carpet tile-receiving space described above. A carriage for supporting the knife blade is also provided which is shiftably mounted on the channel member for reciprocal, horizontal movement thereof during cutting and blade retracting operations.

In the use of the cutter of the present invention, the base plate is situated atop an endmost field tile with the depending stop surface in abutting relationship to the exposed edge of the field tile. At this point a fresh carpet tile in an inverted condition is slid into the space between the upper surface of the cutter base plate and the knife mounting assembly until the tile engages the adjacent baseboard or wall. The knife-supporting carriage is then shifted in order to in turn move the cutting blade into and through the carpet tile in order to cut a terminal tile section of proper dimensions.

BRIEF DESCRIPTION OF THE DRAWINGS

FIG. 1 is a front elevational view of a carpet tile cutter in accordance with the invention, with a tile to be cut illustrated in phantom in operative position within the cutter;

FIG. 2 is a plan view of the carpet tile cutter depicted in FIG. 1;

FIG. 3 is a fragmentary enlarged view of the cutter, depicting in detail the knife-supporting carriage assembly;

FIG. 4 is a vertical sectional view of a cutter in accordance with the invention, shown during cutting operations on a carpet tile;

FIG. 5 is a fragmentary view illustrating portions of the knife-supporting carriage assembly permitting vertical adjustment of the cutting blade;

FIG. 6 is a bottom view with parts broken away for clarity illustrating the details of the channel and knife-supporting carriage assembly; and FIG. 7 is a plan view illustrating a cutting operation using the cutter of the invention.

DESCRIPTION OF THE PREFERRED EMBODIMENT

Turning now to the drawings, a carpet tile cutter 10 is illustrated in FIGS. 1 and 2. The cutter 10 broadly includes a base plate 12 of substantially planar configuration, and having a stop 14 secured to the underside thereof in depending relationship. The overall cutter 10 further includes a knife blade 16 designed for cutting carpet tile, together with means broadly referred to by the numeral 18 for mounting the blade 16 for horizontal, reciprocal cutting movement thereof in an elevated position above the base plate 12.

In more detail, the base plate 12 is of metallic construction and includes a generally planar upper surface 20 and an opposed, generally planar bottom surface adapted to rest on a carpet tile. Generally speaking, the plate 12 should be of a width greater than the normal width of carpet tiles as seen, e.g., in FIG. 7.

The base plate is further provided with an elongated, L-shaped in cross section guide 24 which is affixed to upper surface 20 and is in perpendicular relationship to the elongated stop 14. Moreover, the guide 24 may be provided with a convenient measuring scale 26 (see FIG. 4) in the event that it is desired to actually meaure a distance to be cut on a carpet tile. Finally, the plate 12 may be provided with an elongated slot 30 adjacent the rearmost end thereof remove from stop 14, to facilitate carrying of the overall cutter 10.

The stop 14 is in the form of an elongated, L-shaped in cross section angle 30 which is permanently affixed to bottom surface 22 of plate 12 adjacent the forward or cutting end of the latter. As best seen in FIG. 4, the angle 30 includes a depending, generally vertically extending leg 32 presenting an upright, essentially vertical stop surface 34 designed for abutting the exposed edge of a carpet tile resting upon a floor surface.

The blade 16 is advantageously in the form of a conventional, trapezoidally shaped metallic blade 36 presenting a cutting edge 38. Blade 36 is adapted for mounting in an upright, essentially vertical orientation with edge 38 being angularly oriented, so that horizontal shifting movement thereof effects cutting of the carpet tile.

The blade mounting means 18 broadly includes an elongated channel member 40 together with a carriage 42 shiftable along the length of the channel member 40 and supporting blade 36. In detail, the channel member 40 is affixed to upper surface 20 of plate 12 and includes a pair of upright, spaced apart sidewalls 44, 46, and an elongated top wall 48 having an elongated slot 50 along the length thereof. A pair of upright end walls 52, 54 also form a part of the channel members and are affixed to surface 20 of plate 12 as best shown in FIG. 1. It will further be observed that the end walls 52, 54 are of a greater height than the corresponding sidewalls 44, 46; as a consequence, an elongated space 55 is created between the lower termini of the walls 44, 46 and surface 20 of plate 12. Finally, as seen in FIGS. 1 and 2, the end walls 52, 54 are adjacent the side marginal edges of plate 12 so that the overall assembly 18 and space 55 can easily accommodate carpet tiles of normal dimensions. Finally, it will be seen that an elongated bearing wall 56 presenting a depending bearing-engaging section 58 is secured to the face of upright wall 46 remote from walls 44; the importance of this structure will be made clear hereinafter.

The carriage 42 includes a primary, L-shaped wall 60 which has a horizontal stretch 62 designed to be situated above top wall 48 of channel member 40, and a depending stretch 64 oriented to lie in spaced, generally parallel relationship to sidewall 46. The upper stretch 62 is provided with a total of four rotatable bearings 66 mounted on respective bolts 68, together with a central, upright operating handle 70 affixed to the stretch 66 by means of bolt 72. As best seen in FIG. 4, the respective bearings 66 are arranged in pairs, with each fore and aft pair being adapted to engage and receive a corresponding slot-defining edge of top wall 48. Additionally, another pair of bearings 74 are affixed to the inner face of horizontal stretch 64 by means of bolts 76 and wing nuts 78. This bearing pair engages the underside of section 58 of bearing wall 56 during movement of the carriage 42. It will thus be appreciated that the bearings 66, 74 serve to stabilize and permit smooth reciprocation of the carriage along the length of channel member 40.

The overall carriage 42 further includes a secondary wall 80 which is affixed to vertically extending stretch 64 of primary wall 60. The secondary wall 80 includes an inturned, bottommost foot 82, together with an uppermost, central adjustment slot 84 and corresponding, lower, spaced apart slots 86, 88, adapted to receive the bearing mounting bolts 76 (see FIG. 5).

The face of secondary wall 80 remote from vertical stretch 64 is provided with a pair of blade-supporting protrusions 90, 92. As best seen in FIG. 5, these protrusions are respectively disposed about the slots 86, 88, and moreover have corresponding, angularly oriented, parallel blade-engaging surfaces which cooperatively define therebetween a space for receipt of the blade 36. Attachment of the blade 36 to secondary wall 80 is completed by means of a clamping plate 94 which is apertured to receive the bolts 76. In this fashion, tightening of the wing nuts 78 serves to press the plate 94 into clamping engagement with the blade 36 to hold the same in a desired cutting orientation. This tightening, together with tightening of upper wing nut 96 on bolt 98 (the bolt passing through upper slot 84, see FIG. 5) serves to affix the secondary wall 80 to the primary wall 60 of the overall carriage assembly.

The use of tile cutter 10 can best be understood from a consideration of FIGS. 1, 2 and 7. Thus, in the context of laying carpet tile, the installers would conventionally position the field tiles 100 on floor surface 102 until a point was reached where the spacing between the field tiles and an adjacent wall surface 104 was such that tile pieces needed to be specially cut to complete the installation. At this point, the cutter 10 is employed. In the first step, the cutter is positioned on a selected terminal field tile 100*a* with the surface 34 of stop 14 in abutting engagement with the exposed edge of that tile (see FIGS. 4 and 7). The remainder of the base plate 12 simply rests atop the tile 100*a*, as well as adjacent field tiles. The installer then inverts a tile 106 to be cut so that the backing 108 thereof faces upwardly, whereupon the tile is placed on upper surface 20 of plate 12 and is slid forwardly beneath the lower terminal edges of the walls 44, 46, until the forewardmost edge of the inverted tile comes into engagement with wall surface 104. For this purpose, the lateral edge of the tile is conveniently placed against guide 24 to ensure a perpendicular cut.

The next step involves adjusting the secondary wall 80 and the blade 36 for proper cutting operations. That is to say, the wing nuts 78, 96 are loosened and the installer slides the secondary walls 80 downwardly until foot 82 engages the backing 108 of tile 106 (see FIG. 4), and at the same time the blade 36 is adjusted upwardly or downwardly as required to ensure proper and complete cutting of the tile. At this point the wing nuts 78, 96 are retightened. The installer next grasps handle 70 and pushes the carriage assembly 42 along the length of channel member 40 so as to quickly and cleanly cut the tile 106 to present a cut tile section 110 which is properly dimensioned for fitting in the space between the field tile 100*a* and wall surface 104. In this regard, it will be observed that the carriage assembly supports blade 36 in an upright disposition which is in substantial alignment with stop surface 34 of the stop 14. This ensures that the cut tile section 110 properly fits between the field tile 100*a* and wall surface 104. Moreover, provision of the bearings 66, 74 ensures smooth cutting operation and long cutter life.

In continued cutting operations, the installer need only work his way down the length of the installed field tile, successively cutting sections for insertion into corresponding floor spaces. Of course, dimensional irregularities in the floor and building are automatically accommodated using the cutter, inasmuch as a separate, individualized tile section is cut for each respective field tile.

I claim:

1. A carpet tile cutter for cutting terminal pieces of carpet tile to be inserted between field carpet tile and an adjacent baseboard, said cutter comprising:

a baseplate presenting an underside, a flat, planar, opposed, carpet tile-supporting upper surface, a forward margin and a rearward margin;

an elongated stop depending from said baseplate underside and having an elongated, upright stop surface for abutting the exposed edge of said field carpet tile, said stop surface being closely adjacent said forward margin whereby only a short, forwardly projecting portion of said baseplate occupies the region between said exposed carpet tile edge and said adjacent baseboard;

an elongated, rigid body permanently secured to said baseplate and presenting an upright guiding surface, and an elongated lower surface, said body lower surface being spaced above said baseplate upper surface to cooperatively define a carpet tile-receiving slot therebetween, said cutter presenting an unimpeded, obstruction-free space communicating with and having the same cross-sectional dimensions as said slot and extending both forwardly and rearwardly therefrom to and beyond both said forward and rearward margins of the baseplate for permitting slidable insertion of a carpet tile to be cut from a point adjacent said rearward marginal edge forwardly through said slot and into engagement with said baseboard;

a knife blade;

means operably coupling said blade to said rigid body for horizontal, reciprocal cutting movement thereof in an elevated position above said upper surface and in tile cutting disposition in substantial alignment with said stop surface;

means adjacent the cutting path of said blade for engaging said tile to be cut and preventing unintended upward movement thereof during cutting operations;

means mounting said tile-engaging means for up and down adjustment thereof to accommodate tiles of varying thickness, and for operative positioning of the tile-engaging means in close, upward movement-preventing relationship to said tile to be cut with the vertical distance between said tile-engaging means and the tile to be cut being less than the thickness of the tile to be cut.

2. The cutter of claim 1, said tile-engaging means being mounted for reciprocal movement thereof with said knife blade.

3. The cutter of claim 1, said stop comprising an angle having a pair of perpendicular stretches, one of said stretches being affixed to said plate underside, with a surface of the other of said stretches presenting said stop surface.

4. The cutter of claim 1, including an elongated, carpet tile-engaging guide affixed to said upper surface in perpendicular relationship to said stop.

5. The cutter of claim 1, said knife-supporting body comprising:

an elongated channel member;

a knife blade carriage including means for supporting the blade in an upright disposition;

means shiftably mounting said carriage on said channel member for reciprocal movement thereof along.

6. The cutter of claim 5, said blade-coupling means having structure for permitting vertical adjustment of the blade to vary the depth of cut thereof.

7. The cutter of claim 5, including an upright operating handle secured to said carriage.

* * * * *